United States Patent [19]

Ochiai

[11] 4,307,493

[45] Dec. 29, 1981

[54] VELVET TYPE FASTENER TAPE

[75] Inventor: Koichi Ochiai, Tokyo, Japan

[73] Assignee: Yoshida Kogyo K. K., Tokyo, Japan

[21] Appl. No.: 135,519

[22] Filed: Mar. 31, 1980

[30] Foreign Application Priority Data

Apr. 5, 1979 [JP] Japan ..... 54-41473

[51] Int. Cl.[3] ..... A44B 13/00

[52] U.S. Cl. ..... 24/204

[58] Field of Search ..... 24/201 C, 204, 208 A, 24/205.12

[56] References Cited

U.S. PATENT DOCUMENTS

| | | | |
|---|---|---|---|
| 2,709,290 | 5/1955 | Rosenthal | 24/204 |
| 2,717,437 | 9/1955 | Mestral | 24/204 |
| 3,009,235 | 11/1961 | Mestral | 24/204 X |
| 3,191,255 | 6/1965 | Nealis | 24/204 X |
| 3,192,589 | 7/1965 | Pearson | 24/204 |
| 3,353,663 | 11/1967 | Kayser et al. | 24/204 |
| 3,808,648 | 5/1974 | Billarant | 24/204 |
| 3,961,398 | 6/1976 | Herterich | 24/204 X |
| 4,169,303 | 10/1979 | Lemelson | 24/204 |
| 4,189,809 | 2/1980 | Sotos | 24/204 |

*Primary Examiner*—Roy D. Frazier
*Assistant Examiner*—Peter A. Aschenbrenner
*Attorney, Agent, or Firm*—Bucknam and Archer

[57] ABSTRACT

A velvet type fabric tape for use as closing means or fasteners for garments, curtains and the like. The fastener tape comprises a woven foundation structure, and a number of material-engaging elements raised from one of opposite surfaces of the foundation structure. Each of the material-engaging elements is in the form of a mushroom-shaped loop having a pair of stalks juxtaposed on the foundation structure and an umbrella-shaped head borne on the stalks. The umbrella-shaped head includes a pair of material-hooking eaves each projecting from one of the stalks substantially parallel to the foundation structure for trapping loops on a companion fastener tape.

5 Claims, 6 Drawing Figures

VELVET TYPE FASTENER TAPE

BACKGROUND OF THE INVENTION

1. Field of the Invention

The present invention relates generally to closures or fasteners for garments, curtains and the like, and more particularly to a velvet type fastener tape capable of interlocking with a companion fastener tape.

2. Prior Art

U.S. Pat. No. 2,717,437 discloses a fastening device comprising two woven fabric tapes of the velvet type having a number of hooks raised therefrom. The hooks on one of the two tapes engage with those on the other, making the fastener tapes capable of interlocking with themselves. The hooks of the prior device are provided by forming loops on the individual tape with at least one of warp thread of synthetic resin material and thermally setting the loops formed on the tape, after which the loops are cut on one side of the tape so that each loop produces at least one pile thread having a hook-shaped end.

According to U.S. Pat. No. 3,009,235, a fastening device consists of a number of hooks on one of two companion carrier tapes and a number of loops on the other. The hooks of this prior art are formed in substantially the same manner as those of U.S. Pat. No. 2,717,437.

Another known fastening device utilizes a number of mushroom-shaped stems as loop-engaging elements. The mushroom-shaped stems are provided by forming loops on a carrier tape with at least one of warp thread of synthetic resin material and cutting the loops at the top, after which the individual pile threads are thermally treated at the cut ends so that each pile thread has a swelled end.

Thus, according to the prior art, the loop-cutting, which usually requires a complicated and thus expensive cutting machine, is essential to provide the hook-shaped or mushroom-shaped engaging elements, with or without thermal treatment. In addition, the loop-engaging elements of the conventional devices are liable to come out from the carrier tape because they are in the form of discrete pile threads.

SUMMARY OF THE INVENTION

A velvet type fastener tape of the present invention comprises a number of material-engaging elements in the form of a mushroom-shaped loop raised from a foundation structure. The loop is constituted by a pair of stalks juxtaposed on the foundation structure and an umbrella-shaped head borne on the stalk. The head of the loop includes a pair of material-hooking eaves each projecting from one of the stalks substantially parallel to the foundation structure for trapping at least one of a number of loops carried on a companion fastener tape. In use, if these two fastener tapes are pressed against each other, the loops on the companion tape are trapped by the mushroom-shaped loops on the first-named fastener tape, making the two fastener tapes capable of interlocking with themselves reliably with maximum ease.

It is therefore an object of the present invention to provide a velvet type fastener tape which is free from coming out of loop-engaging elements as well as the breadage thereof at the roots.

Another object of the invention is to provide a closing means or fasteners for garments, curtains and the like, which enables a large number of reclosures.

Still another object of the invention is to provide a velvet type fastener tape which can be produced less costly.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION OF PREFERRED EMBODIMENTS

Figure 1:
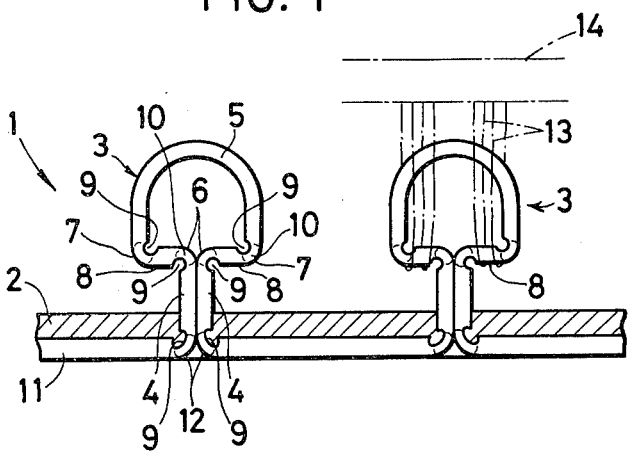
FIG. 1 is a schematic, longitudinal cross-sectional view of a fragment of a velvet type fastener tape according to a first embodiment of the present invention.

The principles of the present invention are particularly useful when embodied in a velvet type fastener tape (hereinafter referred to as 'fastener tape') such as shown in FIG. 1, generally indicated by the numeral 1.

The fastener tape 1 generally comprises a foundation structure 2 woven of weft and warp threads, and a number of material-engaging elements 3 raised from one side of the foundation structure 2. Each of the material-engaging elements 3 is in the form of a mushroom-shaped loop having a pair of stalks 4,4 juxtaposed on the foundation structure 2 and an umbrella-shaped head 5 borne on the stalks 4,4. The umbrella-shaped head 5 includes a pair of material-hooking eaves 8,8 each projecting from one of the stalks 4,4 substantially parallel to said foundation structure.

To produce such material-engaging elements 3, a synthetic resin thread 11 of continuous length having a number of reduced thickness portions 10 at appropriate distances (FIGS. 4 and 5) is woven, by a suitable pile weaving machine (not shown), into the foundation structure 2 so as to have bends 6,7,12 at the reduced-thickness portions 10. Thus the individual material-hooking eave 8 is defined by the bends 6 and 7, while the individual stalk 4 is defined by the bends 6 and 12. At the underside of the foundation structure 3, one of the stalks 4 of each mushroom-shaped loop (3) is connected with one of those of a preceding or succeeding loop (3). The synthetic resin thread 11 preferably comprises a monofilament yarn.

Figure 4:
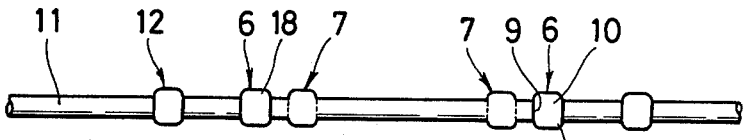
FIG. 4 is a fragmentary, enlarged side elevational view of a monofilamentary thread of synthetic resin material used in the first and second embodiments.
Figure 5:
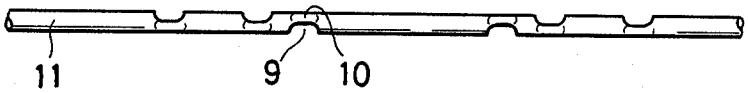
FIG. 5 is a plan view of the thread of FIG. 4.

The reduced-thickness portions 10 may be formed by stamping the continuous thread 11, by means of a pair of coacting press rollers (not shown), such that the thread 11 be provided with a number of grooves 9 on either side (see FIGS. 4 and 5). For this purpose, such press rollers have on their periphery an appropriate set of projections each having the contour corresponding to the shape of the groove 9.

In use, if the two fastener tapes 1 and 14 are pressed against each other, a certain number of the loops 13 on the tape 14 are trapped by the hooking eaves 8,8 of the mushroom-shaped loops 3 carried on the tape 1, as shown in FIG. 1. The two fastener tapes 1 and 14 are thus interlocked with themselves.

In order to separate the interlocked fastener tapes 1 and 14 apart, the tape 14 is gripped on its right side (for instance) margin by the fingers and pulled it obliquely leftwardly (as viewed in FIG. 1) as if peeling an orange. This causes the mushroom-shaped loop 3 to tilt leftwardly, allowing the loops 13 on the tape 14 to release from the right side eave 8 readily. Then, with continued pulling of the tape 14, the mushroom-shaped loop 3 swings back to the right for its own resiliency so that the remaining (left side in FIG. 1) loops 13 can be released from the left side eave 8. Finally, the mushroom-shaped element 3 resiliently returns to the original position, filliping the released loops 13 outwardly. This filliping action facilitates the separation of the two fastener tapes 1 and 14. Thus, the fastener tape 14 is detached from the fastener tape 1 completely.

As is well known in the art, the greater the number of the hooking member mates (i.e. the mushroom-shaped loops 3 and the loops 13) per unit area on the tapes, the more the possibilities of hooking are effected.

Figure 2:
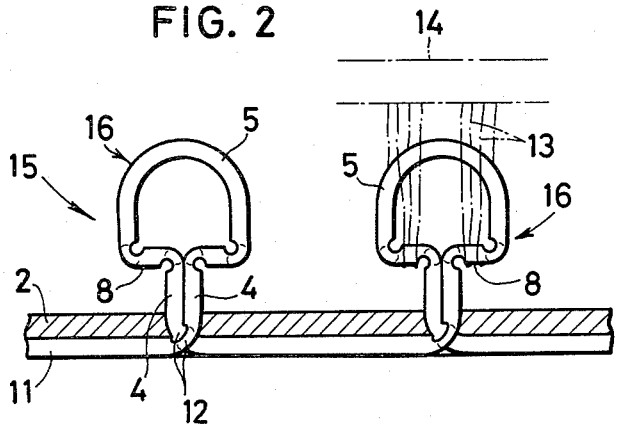
FIG. 2 is a view similar to FIG. 1 but showing a velvet type fastener tape according to a second embodiment.

According to a second embodiment of FIG. 2, a modified fastener tape 15 includes a number of mushroom-shaped elements 16. The two stalks 4,4 of the individual mushroom-shaped element 16 extend across each other at their root portions in the foundation structure 2. With this arrangement, since these opposed stalks 4,4 of the individual mushroom-shaped element 3 do not stand in each other's way as they swing or tilt, enabling smooth separation of the two fastener tapes 1,14.

Figure 3:
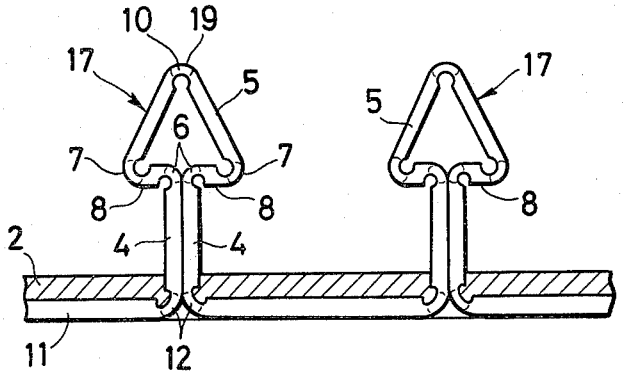
FIG. 3 shows a velvet type fastener tape according to a third embodiment.
Figure 6:
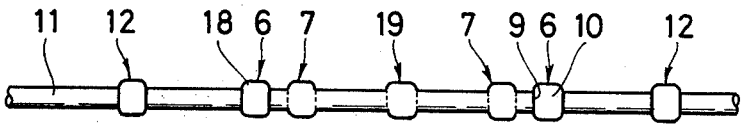
FIG. 6 is a side elevational view of a monofilamentary thread of synthetic resin material used in the third embodiment.
Figure 7:
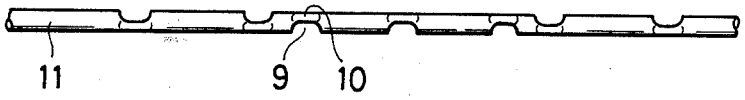
FIG. 7 is a plan view of the thread of the FIG. 6.

According to a third embodiment of FIG. 3, a modified material-engaging element 17 has a triangular head 5 with an acute angle at the top 19, allowing the loops 13 on the companion tape 14 to reach the material-hooking eaves 8 smoothly. The modified material-engaging elements 17 is provided by weaving the monofilamentary thread 11 of FIGS. 6 and 7 into the foundation structure 2, the thread 11 having a number of reduced-thickness portions 10 formed in the manner described above. The reduced-thickness portions 10 have lateral protuberances 18. The protuberances 18 also serve to hook the loops on the companion fastener tape, effecting an increased degree of resistance to separation of the two fastener tapes.

Although various minor modifications may be suggested by those versed in the art, it should be understood that we wish to embody within the scope of the patent warranted hereon, all such embodiments as reasonably and properly come within the scope of my contribution to the art.

What is claimed is:

1. A velvet type fastener tape comprising:

(a) a foundation structure; and (b) a number of material-engaging elements raised from one of opposite surfaces of said foundation structure, each of said material-engaging elements being in the form of a mushroom-shaped loop having a pair of stalks juxtaposed on said foundation structure and an umbrella-shaped head borne on said stalks, said umbrella-shaped head including a pair of material-hooking eaves each projecting from one of said stalks substantially parallel to said foundation structure, the loops of said material-engaging elements being formed with a thread of synthetic resin material.

2. A velvet type fastener tape according to claim 1, said synthetic resin thread including a monofilament yarn.

3. A velvet type fastener tape according to claim 1, said synthetic resin thread having a plurality of reduced-thickness portions, and said material-hooking eaves having been provided by bending said synthetic resin thread at said reduced-thickness portions.

4. A velvet type fastener tape according to claim 1, said synthetic resin thread having been woven into said foundation structure.

5. A velvet type fastener tape according to claim 4, said stalks of the loop of said each material-engaging element extending across each other at their root portions in said foundation structure.

* * * * *